US005893933A

United States Patent [19]

Strahm

[11] Patent Number: 5,893,933

[45] Date of Patent: Apr. 13, 1999

[54] DEVICE AND METHOD FOR THE CONTINUOUS FULLING OF A MATERIAL WEB OF TEXTILE WOVEN FABRICS AND KNITTED FABRICS

[75] Inventor: Christian Strahm, Bronschhofen, Switzerland

[73] Assignee: Solipat AG, Zug, Switzerland

[21] Appl. No.: 08/847,492

[22] Filed: Apr. 25, 1997

[30] Foreign Application Priority Data

May 23, 1996 [CH] Switzerland ..... 1302/96

[51] Int. Cl.[6] ..... D06C 17/00

[52] U.S. Cl. ..... 8/152; 68/177; 26/19; 26/21

[58] Field of Search ..... 26/19, 20, 21, 26/18.5; 68/177, 178, 62, 158, 205 R; 8/152

[56] References Cited

U.S. PATENT DOCUMENTS

| | | | |
|---|---|---|---|
| 4,087,993 | 5/1978 | Sando et al. | 68/177 |
| 4,419,871 | 12/1983 | Zonco et al. | 68/177 |
| 4,422,308 | 12/1983 | Pfeiffer et al. | 26/20 |
| 4,578,085 | 3/1986 | Ishimaru | 68/177 |
| 4,644,765 | 2/1987 | Kito | 68/177 |
| 4,766,743 | 8/1988 | Biancalani et al. | 68/177 |
| 5,274,892 | 1/1994 | Strahm | 26/20 |
| 5,309,613 | 5/1994 | Strahm | 26/27 |
| 5,678,429 | 10/1997 | Zonco | 68/177 |

FOREIGN PATENT DOCUMENTS 535 287 10/1991 European Pat. Off. .

*Primary Examiner*—Amy B. Vanatta
*Attorney, Agent, or Firm*—Shoemaker and Mattare, Ltd.

[57] ABSTRACT

There is disclosed a device for the continuous fulling of a material web (6) of textile woven fabrics and knitted fabrics with a guiding passage (15) through which the material web (6) can be guided through and accelerated by means of a fluid. At the end of the guiding passage (15), there is provided an impact surface (16, 17), against which the material web (6) can be flung by the fluid. Between the impact surface (16, 17) and the guiding passage (15) there are additionally provided guiding means (26, 26') by means of which the material web (6), which is broadly guided in the guiding passage, can be brought together to a material strand (25) before impinging on the impact surface (16, 17).

9 Claims, 2 Drawing Sheets

Figure 1:
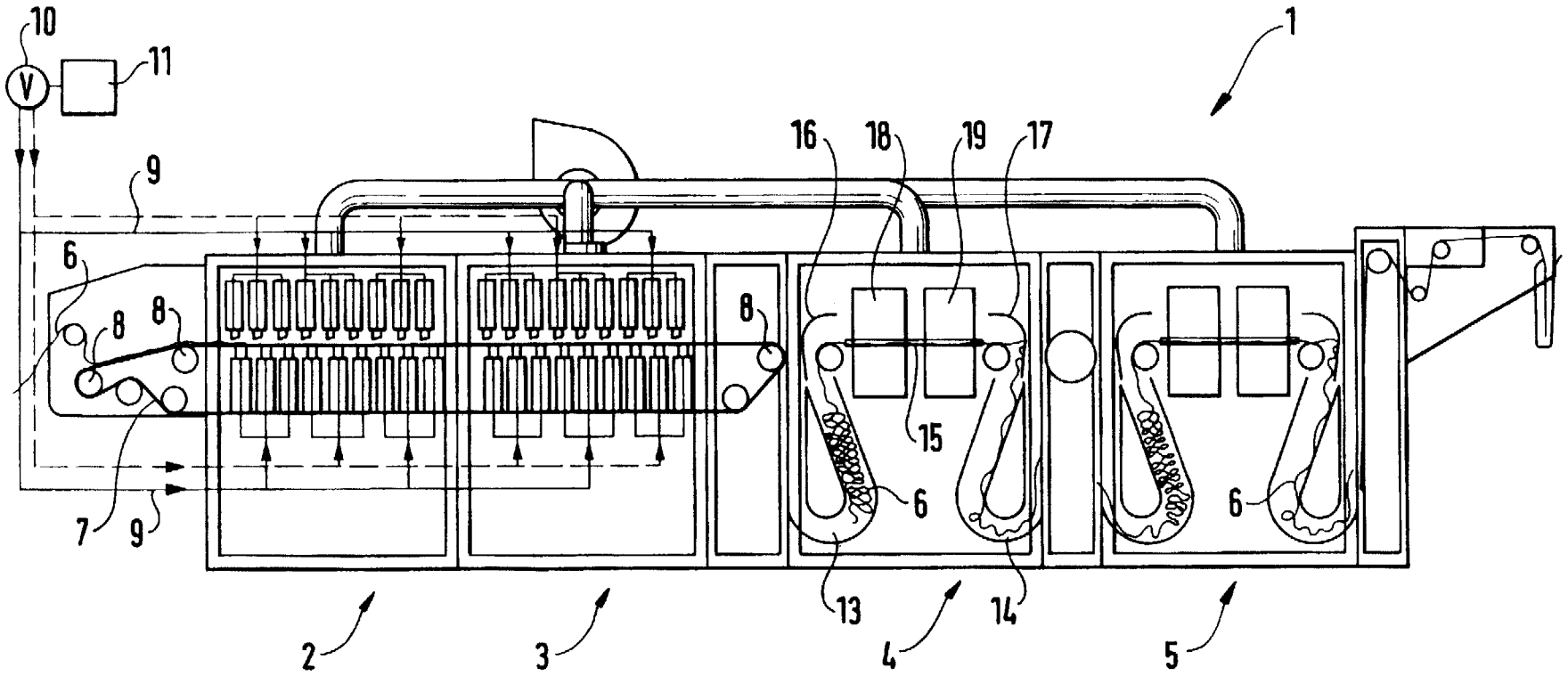

DEVICE AND METHOD FOR THE CONTINUOUS FULLING OF A MATERIAL WEB OF TEXTILE WOVEN FABRICS AND KNITTED FABRICS

The invention relates to a device and a method for the continuous fulling of a material web of textile woven fabrics and knitted fabrics according to the preamble of patent claim 1 and the preamble of patent claim 6 respectively In EP-A-535 287 there is described a method and a device for the continuous improvement of the feel and surface, also called fulling, of textile woven fabrics and knitted fabrics, in which the material web to be treated, by way of pneumatic conveying means, is alternately moved to and fro between a first material web storage device and a second material web storage device, and where it is temporarily stored in a sectioned manner. An advance feed differential is maintained between the conveying directions, wherein the material web is continuously fed to the first material web storage device and fed from the second material web storage device. The material web is accelerated in a guiding and acceleration passage and in each conveying direction is flung and upset against an impact surface arranged at the end of the acceleration stretch. The textile material web may only be guided broadly in the guiding passage and is flung as such against the impact surface.

Alternatively, arrangements are known in which the material is conveyed as a strand and is flung against an impact surface by way of a fluid stream accelerated at high speed.

Accordingly, it is the object of the invention to so improve a method and a device of the type previously mentioned, that a broadly guided material web can, as a material strand, be upset onto an impact surface or fulled as a material strand.

This object is achieved, with regard to the device, by a device with the features of patent claim 1 and with regard to the method, by a method with the features of patent claim 6.

Since the material web, as ever, may be guided broadly in the guiding and acceleration passage, an optimal acceleration of the material web takes place, the material web is however flung as a material strand against the impact surface. Such fulling treatment may give the textile woven fabrics and knitted fabrics a more homogeneous surface and a softer feel. The textile material web is preferably accelerated with guiding bodies for the fluid used for the acceleration. The guiding means for bringing together broadly guided material web to a material strand, in an advantageous manner, comprise guiding nozzles which are aligned either at an obtuse angle or transversely to the conveying direction of the material web. In the first case, the nozzles may simultaneously effect an additional acceleration of the forming material strand. In practice it has been particularly suitable when the guiding means are formed so that they can be turned on and off so when appropriate, there is the possibility of also fulling a broadly guided material web.

It is advantageous with the method according to the invention when the material web to be treated is alternately moved to and fro between a first material web storage device and a second material web storage device and is temporarily intermediately stored there in a sectioned manner. At the same time, the material web is fed out of the one material web storage device and fed to the other material web storage device. Between both material web storage devices, the textile material web is accelerated and in each conveying direction is slung against an impact surface. Practically, it is useful when the material web fed out from the other material web storage device is subsequently subjected at least once again to the same treatment method. It is however not neccessarily required that the material web is brought together to a material strand in both conveying directions, indeed this may also only be foreseen on one side of the guiding passage.

Figure 2:
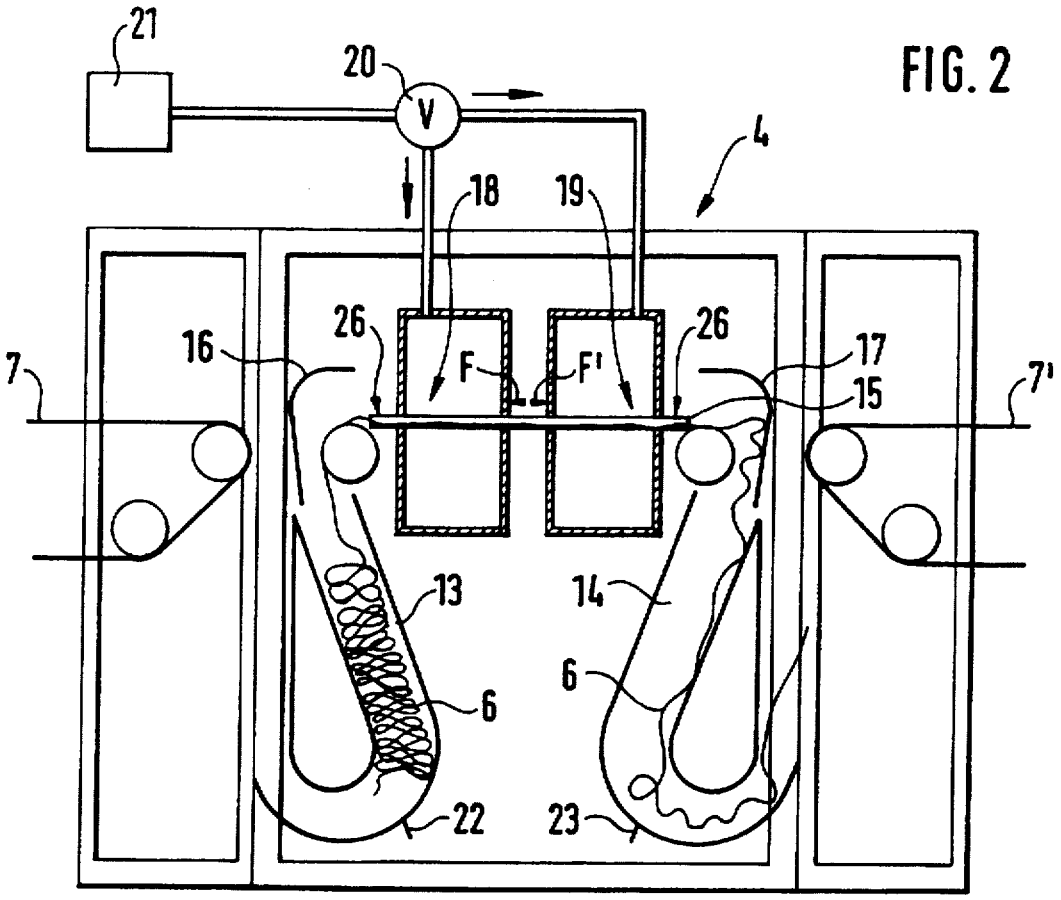
Figure 3:
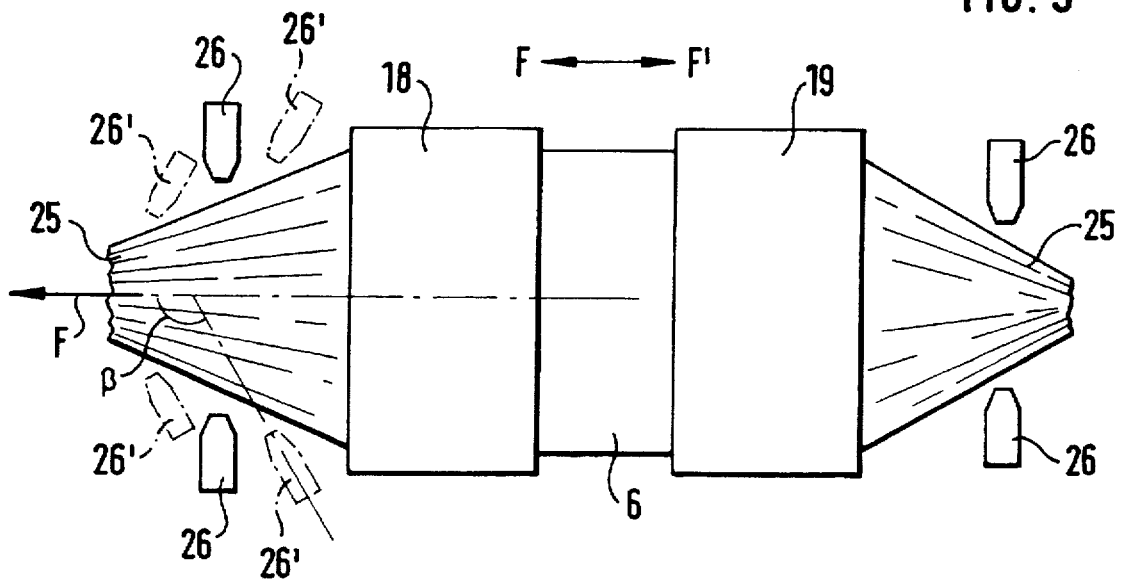

Further advantages of the invention follow from the dependent patent claims and from the following description, in which the invention is described in more detail by way of one embodiment example shown in the schematic drawings. There are shown:

FIG. 1 a schematic view of a machine for treating textile woven fabrics and knitted fabrics, FIG. 2 a cutout from FIG. 1, which shows the fulling device in more detail, and FIG. 3 a plan view of the guiding passage with laterally arranged nozzles.

In the figures in each case the same reference numerals are used for the same elements and the initial description is related to all figures unless mentioned expressly otherwise.

In FIG. 1 there is shown, purely schematically, a machine 1 for fulling and shrinking a textile material web. The machine 1 comrises two shrinkage driers 2 and 3 to which two fulling devices 4 and 5 are topped. The broadly guided textile material web 6, which consists of textile woven fabrics and/or knitted fabrics, is guided through the shrinkage driers 2 and 3 by an endless transport belt 7, where it is dried up to a given residual dampness. The transport belt 7 is formed air pervious and is driven in an endless revolving loop by turning and driving rollers 8. The shrinkage driers 2 and 3 are connected to a hot air source 11 by way of air pipes 9 and a change-over element 10. Details of the design and function of these shrinkage driers 2 and 3 may be deduced from the European Patent application EP-A-535 287 of the same applicant. The contents of this patent application by way of reference is herewith included in the present description.

The fulling device 4 or 5 comprises two approximate U-shaped storage devices 13 and 14 which are connected to one another by a guiding and acceleration passage 15. On the end face to the guiding passage 15, there are provided grid-like formed and curved impact surfaces 16 and 17 against which the textile material web 6 is flung and thus upset. For accelerating the textile material web 6, two groups of conveying means 18 and 19, consisting of blowing nozzles are provided on the guiding passage 15. In order to be able to switch to and fro between the two conveying directions of the textile material web 6 in the guiding passage 15, the groups of conveying means 18 and 19 are connected to a pressurised air source 21 via a flip-flop switching arrangement 20. In order to sample the filling level in both the storage devices 13 and 14, optical sampling means (light barriers) 22 and 23 are provided in the lower region. The textile material web 6 can thus be moved to and fro between both the storage devices 13 and 14 by the groups of conveying means 18 and 19, and thus be fulled, which is described in detail in the above mentioned patent application.

In order to bring together the broadly guided textile material web 3 to a material strand 25, between the guiding passage 15 and the impact surfaces 16 and 17 on both sides and aligned roughly transversely to the conveying direction F, there are provided guiding nozzles 26 which can be turned on and off, as can be seen in FIG. 2 by arrows and in FIG. 3 in a plan view of the guiding passage 15 with the broadly guided textile material web 6. The guiding nozzles 26 are impinged with pressurised air by which means the broadly guided textile material web 6 is brought together to a material strand 25. Depending on the pressure of the pressurised air and on the diameter of the nozzle opening of the guiding nozzles 26, the textile material web 6 is brought together over a shorter or longer stretch. On impact of such a formed material strand 25, there results a different type of fulling than with a broadly guided material web, as is known from the previously mentioned patent application. In particular there results by way of this a softer feel and the surface of the textile material web 6 fulled in such a manner becomes more homogeneous.

Instead of being impinged with pressurised air, the guiding nozzles 26 may also be impinged by a pressurised fluid such as a float or likewise, in order to cause an additional effect at the same time.

The guiding nozzles 26' may also enclose an obtuse angle β (shown dashed in FIG. 3) with the respective conveying direction F, in order to further accelerate the formed material strand 25. Several guiding nozzles 26' (likewise shown dashed) may also be provided on the same side of the textile material web 6 in order to bring it together to a material strand 25 in a stepped manner.

Since the textile material web 6 is constantly broadly guided in the guiding passage 15, the formed material strand 25 is relaxed in the respective storage device 13 or 14 so that the textile woven fabric or knitted fabric, on a further fulling procedure in the opposite direction, is again pulled into the guiding passage 15 as a broadly guided material web 6. In order to ensure that the textile material web 6 is constantly guided broadly in the guiding passage 15, at least the entrances and exits of the guiding passage 15 are formed slit-shaped. In order however to prevent the material web 6 from being already partly brought together in the guiding passage 15, the slit-shaped entrances and exits may be slightly laterally curved downwards This additionally prevents the material web 6 which is brought together, from causing obstructions in the slit-shaped entrances and exits of the guiding passage 15.

With the additional guiding nozzles 26, 26' at both ends of the guiding and acceleration passage 15, as ever, broadly guided textile material webs 6 may be fulled in the style known from the above mentioned European Patent application, in that the guiding nozzles 26, 26' are not turned on.

I claim:

1. In a device for continuously fulling a fabric web, said device comprising a passageway along which the web can br guided and accelerated by a fluid, an impact surface at the end of the passageway, against which impact surface the fabric is flung by the fluid, the improvement comprising means, disposed between the guiding passage and the impact surface, for gathering the web into a strand before it strikes the impact surface.

2. A device according to claim 1, wherein the passageway extends through two fluid guiding bodies in such a way that the web can be accelerated in either direction along the passageway.

3. A device according to claim 1, wherein the gathering means comprises at least one nozzle aligned at an obtuse angle to the conveying direction of the material web.

4. A device according to claim 1, wherein the gathering means comprises at least one nozzle aligned substantially transverse to the conveying direction of the material web.

5. A device according to claim 1, further comprising means for alternatively activating and deactivating the gathering means.

6. A method for continuously fulling a fabric web, said method comprising steps of guiding and accelerating the web through a passage by means of a fluid, gathering the web into a strand, and then flinging the gathered web against an impact surface at the end of the passageway.

7. A method according to claim 6, comprising a further step of moving the web to and fro between a first web storage device and a second web storage device, temporarily storing sections of the web in the storage devices, feeding the web out of one of the storage devices to the other storage device, accelerating the web along a passageway extending between the material web storage devices, and flinging the web against impact surfaces in each conveying direction.

8. A method according to claim 6, wherein the guiding and flinging steps are repeated at least once on the web as it is fed out of the second material web storage device.

9. A method according to claim 6, wherein the web is gathered into a strand only when the web is moving in one conveying direction.

* * * * *